US009139332B1

(12) United States Patent
Roberts et al.

(10) Patent No.: US 9,139,332 B1
(45) Date of Patent: Sep. 22, 2015

(54) RAPID ASSEMBLY SUPPORT STRUCTURE

(71) Applicant: Oddello Industries, LLC, Morristown, TN (US)

(72) Inventors: Thomas A. Roberts, Dandridge, TN (US); Shawn M. Parella, Morristown, TN (US)

(73) Assignee: Oddello Industries, LLC, Morristown, TN (US)

( * ) Notice: Subject to any disclaimer, the term of this patent is extended or adjusted under 35 U.S.C. 154(b) by 0 days.

(21) Appl. No.: 14/485,377

(22) Filed: Sep. 12, 2014

Related U.S. Application Data

(63) Continuation-in-part of application No. 29/498,528, filed on Aug. 5, 2014, and a continuation-in-part of application No. 29/498,533, filed on Aug. 5, 2014, and a continuation-in-part of application No. 29/498,535, filed on Aug. 5, 2014.

(51) Int. Cl.
*B65D 19/00* (2006.01)

(52) U.S. Cl.
CPC ..... *B65D 19/0002* (2013.01)

(58) Field of Classification Search
CPC combination set(s) only.
See application file for complete search history.

(56) References Cited

U.S. PATENT DOCUMENTS

| | | | | | |
|---|---|---|---|---|---|
| 3,736,605 | A * | 6/1973 | Klein, Jr. | 5/679 |
| 3,913,154 | A * | 10/1975 | Sweeney | 5/186.1 |
| 4,085,847 | A * | 4/1978 | Jacalone | 206/600 |
| 4,352,217 | A * | 10/1982 | O'Rourke | 5/680 |
| 4,391,008 | A * | 7/1983 | Yamaoka et al. | 5/200.1 |
| D289,572 | S * | 4/1987 | Wanat | D30/118 |
| 4,729,136 | A * | 3/1988 | Santo | 5/201 |
| 4,734,946 | A * | 4/1988 | Saputo | 5/400 |
| 5,050,257 | A * | 9/1991 | Johenning | 5/671 |
| 5,099,529 | A * | 3/1992 | Anderson | 5/400 |
| 5,285,732 | A * | 2/1994 | Gottlieb | 108/51.3 |
| 5,345,628 | A * | 9/1994 | Keefer | 5/682 |
| 5,469,589 | A * | 11/1995 | Steed et al. | 5/400 |
| 5,473,995 | A * | 12/1995 | Gottlieb | 108/51.3 |
| 5,564,140 | A * | 10/1996 | Shoenhair et al. | 5/400 |
| 5,701,653 | A * | 12/1997 | Rupe | 29/432 |
| 5,728,478 | A * | 3/1998 | Wilson et al. | 428/542.8 |
| 5,749,111 | A * | 5/1998 | Pearce | 5/652 |
| 6,286,161 | B1 * | 9/2001 | McCall | 5/400 |
| 6,493,887 | B1 * | 12/2002 | DeFranks et al. | 5/254 |
| 6,978,498 | B2 * | 12/2005 | Gavela Vazquez | 5/400 |
| 7,703,155 | B1 * | 4/2010 | Roberts et al. | 5/400 |
| 7,784,122 | B2 * | 8/2010 | Oh | 5/201 |
| 7,900,300 | B1 * | 3/2011 | Roberts et al. | 5/400 |
| 8,042,205 | B2 * | 10/2011 | Schulz, Jr. | 5/200.1 |
| 8,122,537 | B1 * | 2/2012 | Roberts | 5/400 |
| 8,584,277 | B1 * | 11/2013 | Roberts | 5/400 |
| 2005/0028274 | A1 * | 2/2005 | Hooper | 5/400 |
| 2005/0235417 | A1 * | 10/2005 | Koughan et al. | 5/400 |
| 2008/0235868 | A1 * | 10/2008 | Snitzer et al. | 5/201 |
| 2010/0175187 | A1 * | 7/2010 | Hall | 5/400 |
| 2011/0203050 | A1 * | 8/2011 | Rogers et al. | 5/285 |

* cited by examiner

*Primary Examiner* — Monica Millner
(74) *Attorney, Agent, or Firm* — Shaddock Law Group, PC

(57) ABSTRACT

A rapid assembly support structure having a top deck panel with a top surface and a bottom surface, side flaps, and corner flaps, and a plurality of drain apertures formed through the top deck panel at spaced apart locations. Side rail elements are affixed to the top surface of the top deck panel, atop the side flaps.

18 Claims, 13 Drawing Sheets

RAPID ASSEMBLY SUPPORT STRUCTURE

CROSS-REFERENCE TO RELATED APPLICATIONS

This patent application claims the benefit of U.S. patent application Ser. No. 29/498,528, filed Aug. 5, 2014, U.S. patent application Ser. No. 29/498,533, filed Aug. 5, 2014, and U.S. patent application Ser. No. 29/498,535, filed Aug. 5, 2014, the disclosures of which are incorporated herein in their entireties by reference.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE INVENTION

1. Field of the Invention

The present disclosure relates generally to support structures, assemblies, foundations, and bases. In particular, the present invention relates to improved support structure and a method for assembling the support structure.

2. Description of Related Art

Typically, support structures, assemblies, foundations, and bases are constructed by hand from various pieces of Pine or other lightweight woods. These built-up structures are formed in a generally square or rectangular fashion and are sometimes cut at each corner in an effort to produce a rounded corner.

Oftentimes, various external jigs or fixtures are used in order to assemble the numerous components of the assemblies or foundations. Once aligned, the various pieces or components are typically nailed together.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE INVENTION

However, constructing support structures, assemblies, foundations, and bases using known methods is typically time-consuming, requires relatively skilled workers, requires numerous components and tools, and does not always result in a secure or square structure, assembly, foundation, or base.

Additionally, the unassembled components of typical support structures are bulky and can be difficult to transport easily or efficiently.

In contrast, the present invention relates generally to improved support structures, assemblies, foundations, and bases. In particular, the present invention relates to improved support structure and a method for rapidly assembling the support structure.

In various exemplary, non-limiting embodiments, the rapid assembly support structure of the present invention comprises a top deck panel, shaped perimeter or side rail elements, spines, and ribs. In certain exemplary embodiments, the rapid assembly support structure comprises a specifically configured top deck panel, two pair of side rails, two spines and two ribs.

The assembly of the various components of the support structure is typically performed in two stages, an initial assembly stage and a final assembly stage. In the initial assembly stage, the side rails are attached or coupled to the top deck panel. In the final assembly stage, the spines and ribs are assembled together and attached or coupled to the side rails and top deck panel.

The support structure is configured such that it can be laid flat or unfolded for transportation. When opposing side rail elements are brought from a substantially horizontal position to a substantially vertical position and alignment with one another, the support structure forms a substantially square or rectangular foundation, with a multi-lap, interior support structure formed of spines and ribs.

In various exemplary, nonlimiting embodiments, the side rail elements of the rapid assembly support structure are optionally joined, connected, or coupled together using four corner connector elements In various exemplary, nonlimiting embodiments, portions of the side rail elements are optionally joined, connected, or coupled to end portions of the spines and ribs using assembly fasteners.

In various exemplary embodiments, the assembly support structure is constructed of wood, Medium Density Fiberboard (MDF), paper, cardboard, fabric, and/or plastic components. The overall part count is significantly lower than that of other support structures. This low parts count greatly reduces the number of contact points between components in the assembly, and virtually eliminates the potential for bothersome squeaks caused by friction.

In various exemplary embodiments, the profile of the side rail elements provides smooth, rounded horizontal outer edges. Notches are formed into the interior face of the side rail elements and serve to align the interior support rib and spine elements during the assembly process, without the need for external jigs and fixtures.

The interior support rib and spine elements are attached together in an interlocking fashion by means of engineered half-lap joints and form a supplemental load distribution structure of the support structure. The rib and spine elements also serve to square the entire assembly support structure during and after assembly.

Aesthetically, the corner connector elements, if included, serve to round the vertical outer edges of the assembly support structure, while maintaining the radii of the assembly support structure's top and bottom edges. Structurally, the corner connector elements provide substantial impact resistance to corner loading and flexible resistance to parallelogram deformation.

The top deck panel is typically a sheet of, paper, cardboard, fabric, plastic, Tyvek®, or other material, which provides a surface upon which a mattress or other material or item will sit.

In various exemplary embodiments, there is elements of the assembly support structure are fastened together with adhesives. Alternatively, screws or other fasteners may be used to assemble the elements of the support structure. In still other embodiments, both adhesive and screws or other fasteners may be used.

Accordingly, this invention provides a support structure of improved design.

This invention separately provides a support structure having a lower overall part count when compared to other support structures.

This invention separately provides a support structure having improved structural stability.

This invention separately provides a support structure that can be easily assembled.

This invention separately provides a support structure that can be assembled without the need for external jigs and/or fixtures.

This invention separately provides a support structure that can be scaled.

This invention separately provides a support structure, wherein the unassembled components of the assembly support structure have a comparatively flat profile and can be easily and efficiently transported.

This invention separately provides a support structure that is less expensive to manufacture.

This invention separately provides a support structure, wherein the unassembled components of the assembly support structure are relatively lightweight.

These and other aspects, features, and advantages of the present invention are described in or are apparent from the following detailed description of the exemplary, non-limiting embodiments of the present invention and the accompanying figures. Other aspects and features of embodiments of the present invention will become apparent to those of ordinary skill in the art upon reviewing the following description of specific, exemplary embodiments of the present invention in concert with the figures. While features of the present invention may be discussed relative to certain embodiments and figures, all embodiments of the present invention can include one or more of the features discussed herein. Further, while one or more embodiments may be discussed as having certain advantageous features, one or more of such features may also be used with the various embodiments of the invention discussed herein. In similar fashion, while exemplary embodiments may be discussed below as device, system, or method embodiments, it is to be understood that such exemplary embodiments can be implemented in various devices, systems, and methods of the present invention.

Any benefits, advantages, or solutions to problems that are described herein with regard to specific embodiments are not intended to be construed as a critical, required, or essential feature(s) or element(s) of the present invention or the claims.

BRIEF DESCRIPTION OF THE SEVERAL VIEWS OF THE DRAWINGS

As required, detailed exemplary embodiments of the present invention are disclosed herein; however, it is to be understood that the disclosed embodiments are merely exemplary of the invention that may be embodied in various and alternative forms, within the scope of the present invention. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present invention.

The exemplary embodiments of this invention will be described in detail, with reference to the following figures, wherein like reference numerals refer to like parts throughout the several views, and wherein.

DETAILED DESCRIPTION OF THE INVENTION

Figure 1:
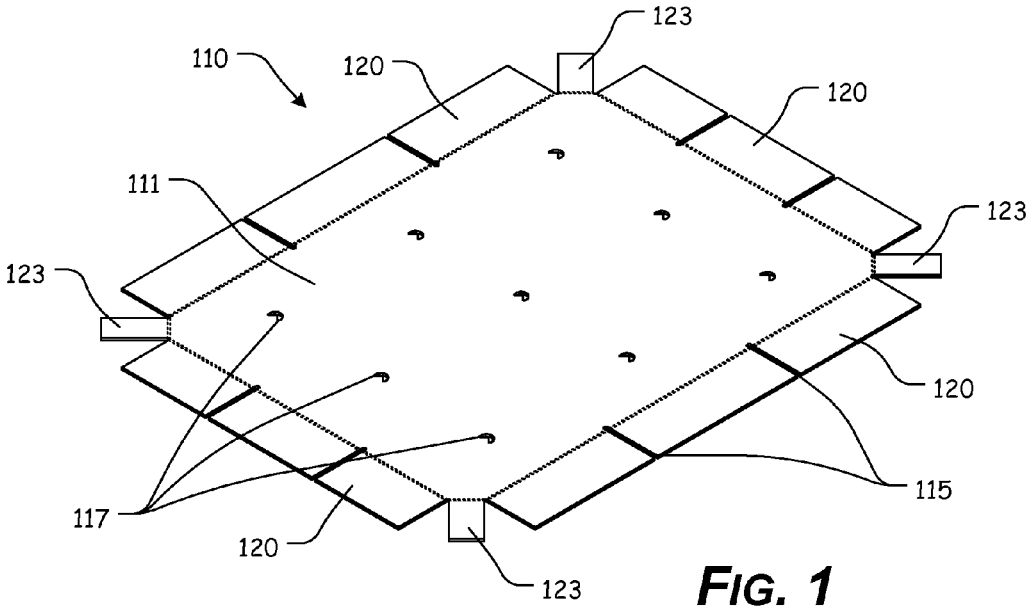
FIG. 1 illustrates a top, perspective view of a first exemplary embodiment of a top deck panel of the rapid assembly support structure, according to this invention.
Figure 2:
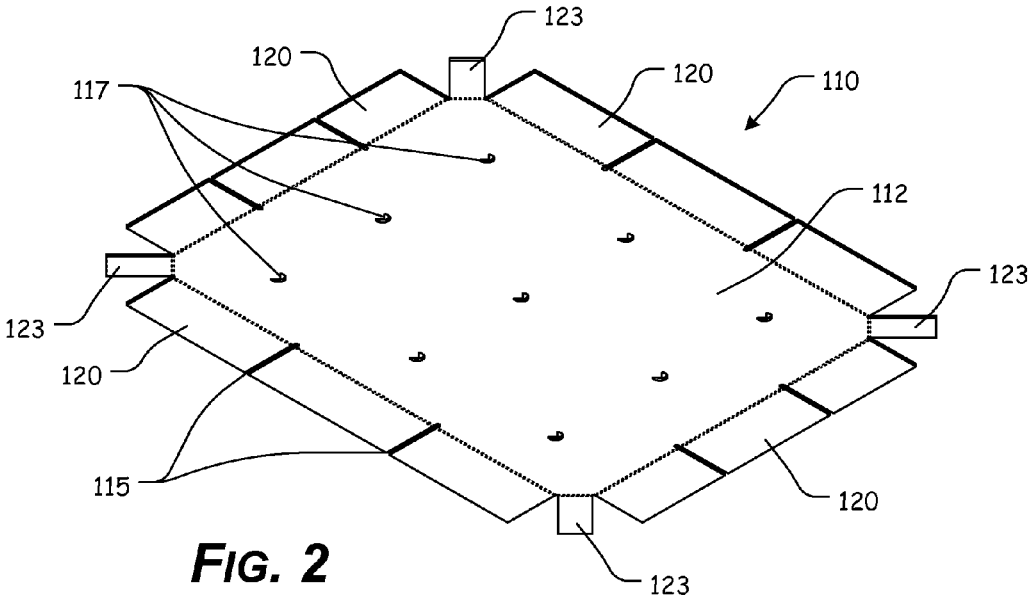
FIG. 2 illustrates a bottom, perspective view of a first exemplary embodiment of a top deck panel of the rapid assembly support structure, according to this invention.
Figure 3:
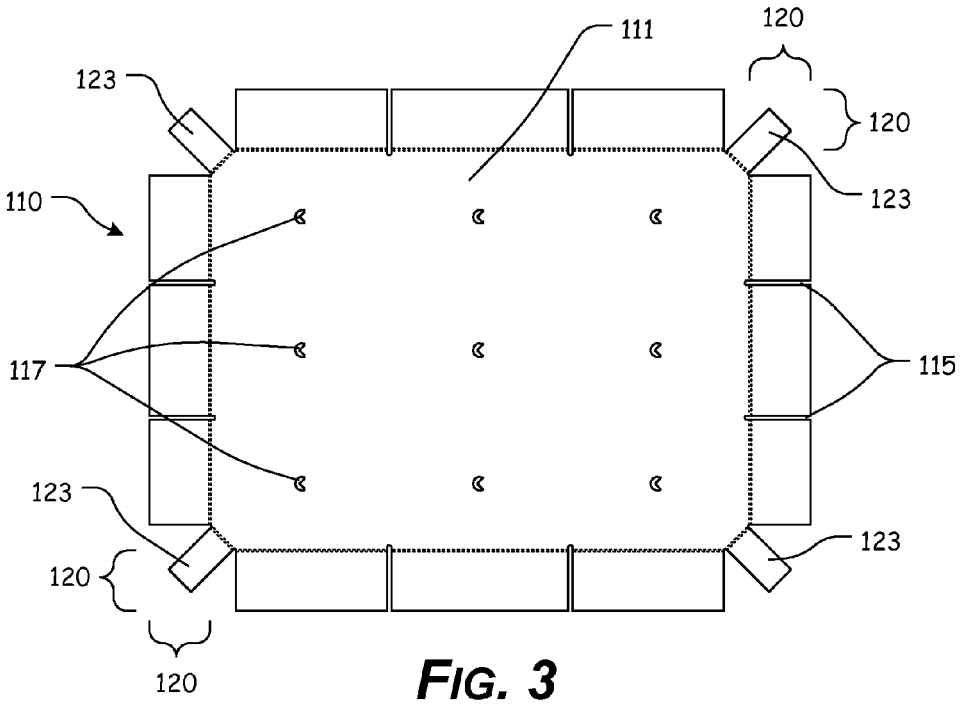
FIG. 3 illustrates a top view of a first exemplary embodiment of a top deck panel of the rapid assembly support structure, according to this invention.
Figure 4:
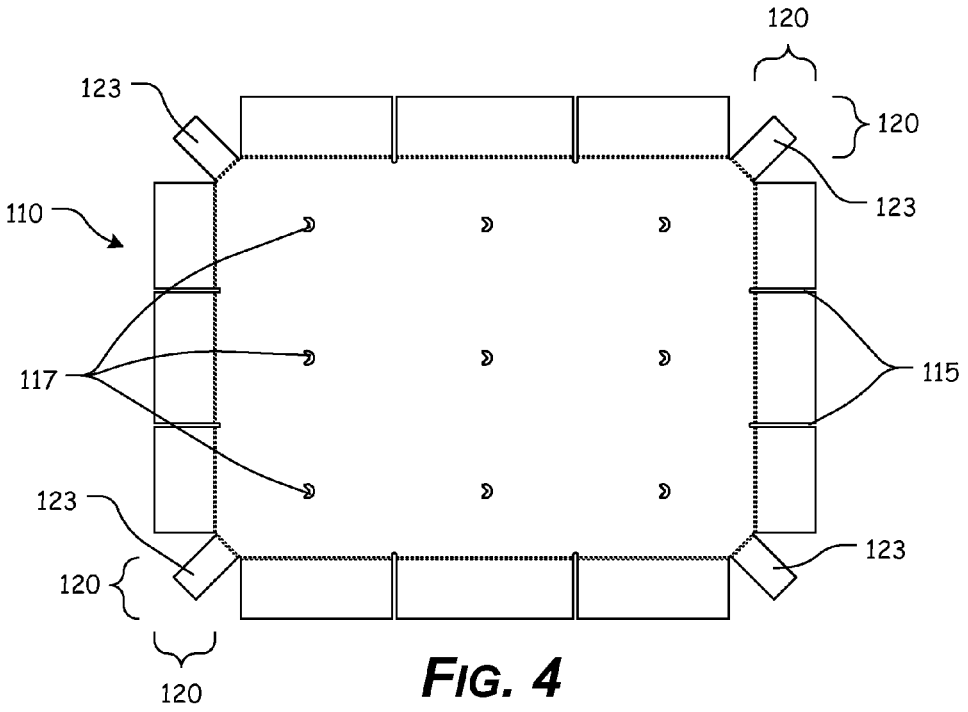
FIG. 4 illustrates a bottom view of a first exemplary embodiment of a top deck panel of the rapid assembly support structure, according to this invention.
Figure 5:
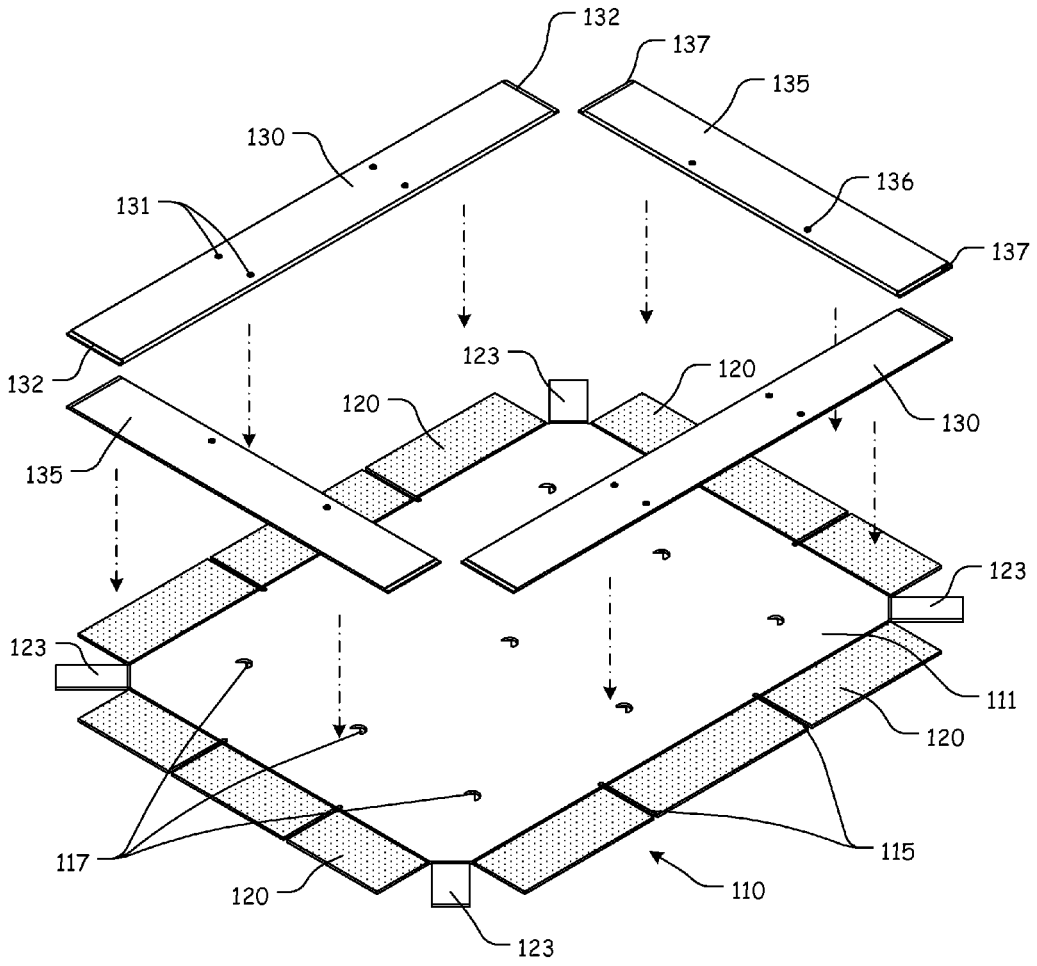
FIG. 5 illustrates an exploded, top, perspective view showing a first exemplary embodiment of a top deck panel and various side rail elements of the rapid assembly support structure, according to this invention.
Figure 6:
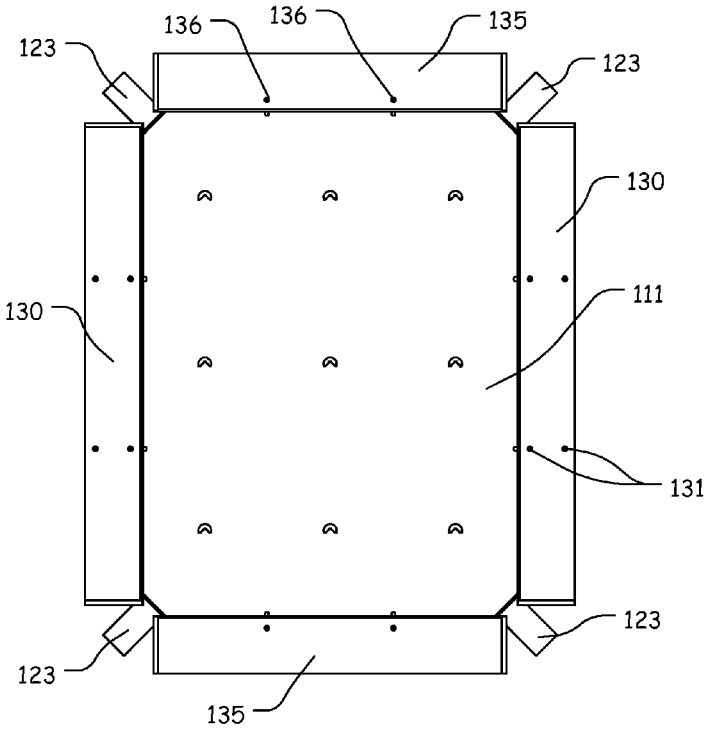
FIG. 6 illustrates a top view showing a first exemplary embodiment of a top deck panel having various side rail elements attached or coupled to the top deck panel, according to this invention.
Figure 7:
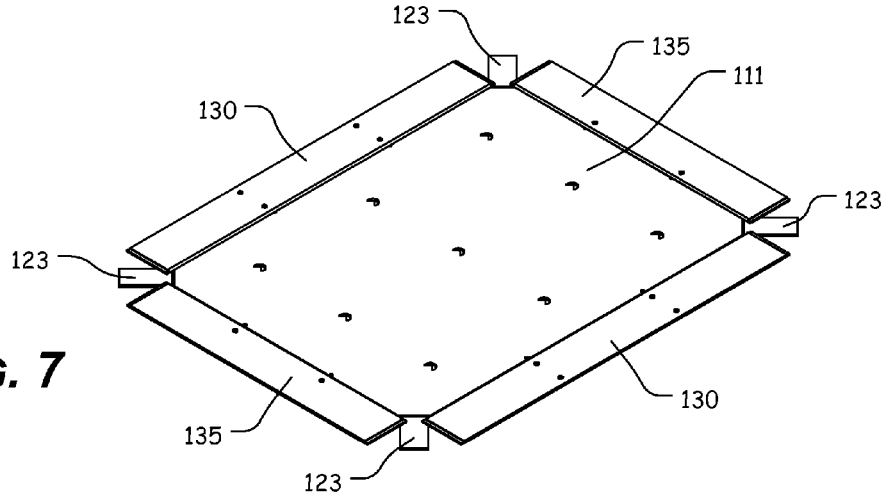
FIG. 7 illustrates a top, perspective view showing a first exemplary embodiment of a top deck panel having various side rail elements attached or coupled to the top deck panel, according to this invention.
Figure 8:
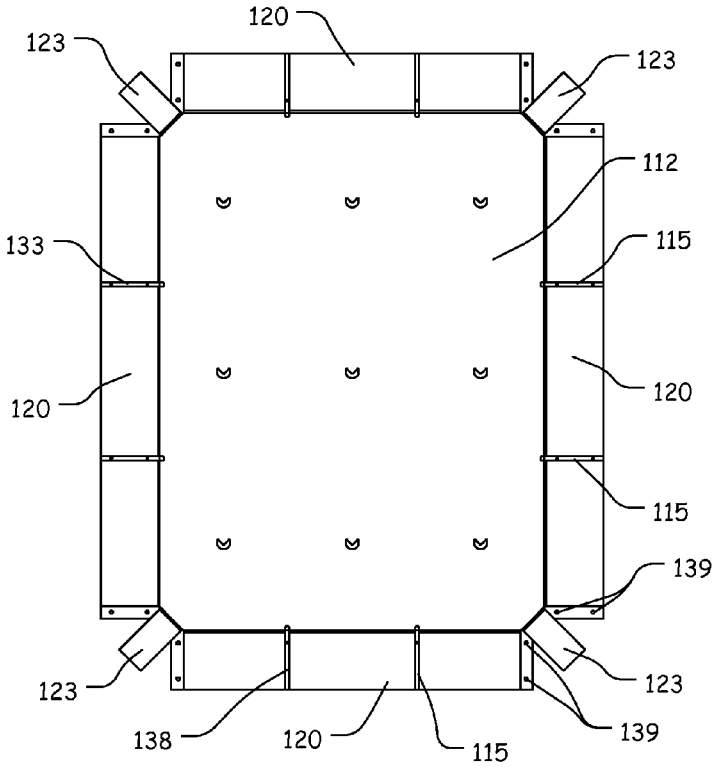
FIG. 8 illustrates a bottom view showing a first exemplary embodiment of a top deck panel having various side rail elements attached or coupled to the top deck panel, according to this invention.
Figure 9:
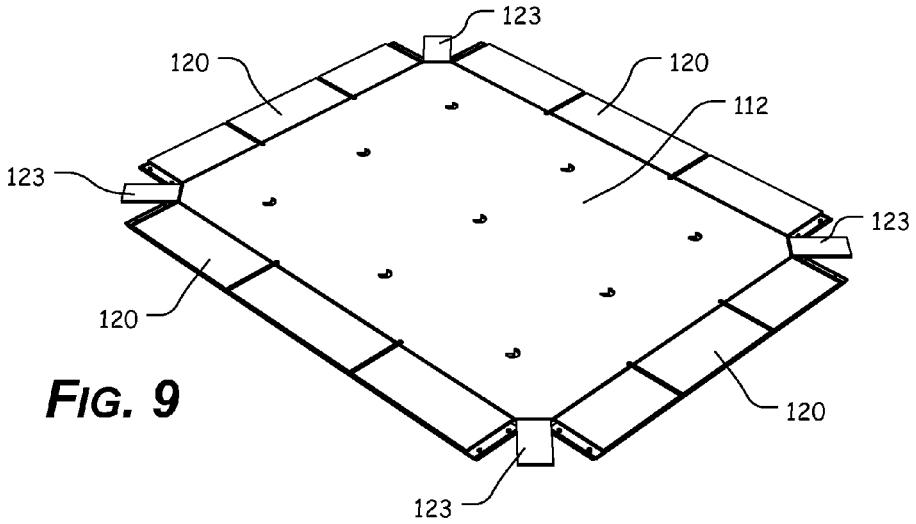
FIG. 9 illustrates a bottom, perspective view showing a first exemplary embodiment of a top deck panel having various side rail elements attached or coupled to the top deck panel, according to this invention.

For simplicity and clarification, the design factors and operating principles of the rapid assembly support structure according to this invention are explained with reference to various exemplary embodiments of a rapid assembly support structure according to this invention. The basic explanation of the design factors and operating principles of the rapid assembly support structure is applicable for the understanding, design, and operation of the rapid assembly support structure of this invention. It should be appreciated that the rapid assembly support structure can be adapted to many applications where a support structure or stage can be used.

Additionally, the rapid assembly support structure of this invention will be described as being used as a support structure for a mattress foundation. However, it should be appreciated that these are merely exemplary embodiments of the rapid assembly support structure and are not to be construed as limiting this invention. Thus, the rapid assembly support structure of this invention may be utilized in conjunction with any object or device.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the elements such terms describe. Thus, these terms are not necessarily intended to indicate temporal or other prioritization of such elements.

The term "coupled" is defined as connected, although not necessarily directly, and not necessarily mechanically. The terms "a" and "an" are defined as one or more unless stated otherwise. The terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are open-ended linking verbs. As a result, a system, device, or apparatus that "comprises", "has", "includes", or "contains" one or more elements possesses those one or more elements but is not limited to possessing only those one or more elements. Similarly, a method or process that "comprises," "has," "includes" or "contains" one or more operations possesses those one or more operations but is not limited to possessing only those one or more operations. Thus, it will be understood that these terms are meant to imply the inclusion of a stated element, integer, step, or group of elements, integers, or steps, but not the exclusion of any other element, integer, step, or group of elements, integers, or steps.

It should also be appreciated that the terms "support structure", "rapid assembly support structure", and "corner connector" are used for basic explanation and understanding of the operation of the systems, methods, and apparatuses of this invention. Therefore, the terms "support structure", "rapid assembly support structure", and "corner connector" are not to be construed as limiting the systems, methods, and apparatuses of this invention. Thus, the terms "support structure" and "rapid assembly support structure" are to be understood to broadly include any structures or devices capable of supporting a load, while the term "corner connector" is to be understood to broadly include any structure or device capable of joining two or more elements at a given angle.

Turning now to the drawing Figs., FIGS. 1-21 illustrate certain elements and/or aspects of a first exemplary embodiment of the rapid assembly support structure, according to this invention. In illustrative, non-limiting embodiment(s) of this invention, as illustrated in FIGS. 1-21, the support structure 100 comprises at least some of a top deck panel 110, a plurality of shaped perimeter or side rail elements 130 and 135, spine elements 140, rib elements 150, and optional corner connector elements 160.

In various exemplary embodiments, the top deck panel 110 comprises a portion of material having a top surface 111 and a bottom surface 112. As illustrated, the top deck panel 110 is substantially rectangular. However, it should be appreciated that the top deck panel 110 may comprise any desired geometric shape, including, for example, a substantially triangular, square, rectangular, pentangular, or other desired shape. Thus, it should be understood that the general overall shape of the top deck panel 110 of the support structure 100 is a design choice based on the desired appearance and functionality of the support structure 100.

In certain exemplary, non-limiting embodiments, all or portions of the top deck panel 110 is formed of a fabric or other material, such as, for example, paper, cardboard, plastic, Tyvek®, woven fabrics, canvas, acrylics, sheet fabrics, films, nylon, spandex, vinyl, Polyvinyl Chloride (PVC), neoprene, or other material, which provides a surface upon which a mattress or other material or item can be placed. Additionally, all or portions of the top deck panel 110 may be made of any flexible and/or elastic material and may stretch. Alternatively, all or portions of the top deck panel 110 may be formed from multiple, similar or dissimilar materials. In various exemplary, non-limiting embodiments, the top deck panel 110 may be water-resistant or may include a cushion material.

It should be appreciated that the terms fabric and material are to be given their broadest meanings and that the particular fabric(s) or material(s) used to form the top deck panel 110 is a design choice based on the desired appearance and/or functionality of the top deck panel 110.

The top deck panel 110 extends to side flaps 120, which extend generally along each side of the top deck panel 110. Corner flaps 123 extend generally from each corner of the top deck panel 110. While the corner flaps 123 and the side flaps 120 each extend from the top deck panel 110, the corner flaps 123 are separate from the side flaps 120.

The side flaps 120 include one or more panel notches 115 formed through at least a portion of the side flaps 120. The panel notches 115 are formed so as to allow at least an end portion of a spine element 140 or rib element 150 to pass therethrough, as described in more detail below.

A plurality of drain apertures 117 are formed through the top deck panel 110 at spaced apart locations. The drain apertures 117 are positioned so as to provide determined locations for the flow of fluid between the top surface 111 and the bottom surface 112 of the top deck panel 110. Thus, the drain apertures 117 allow for fluid flow or airflow between an item placed atop the support structure 100 and an interior of the support structure 100. For example, moisture or condensation that would typically be trapped between a bottom of a mattress and a top of a mattress support assembly can easily flow through the drain apertures 117, thereby increasing the life of the mattress and the components of the mattress support assembly and reducing and/or eliminating the possibility of bacteria or mold forming between the mattress and the mattress support assembly.

The number, size, shape, and placement of the drain apertures 117 is a design choice based on the desired appearance and functionality of the drain apertures 117 relative to the top deck panel 110.

In various exemplary embodiments, the drain apertures 117 are formed in a relative "C", "U", or "V" shape, thereby forming a resiliently deformable projection, or "drip tip", that can bend or deform downward under the weight of moisture or liquid, so as to direct the moisture liquid toward a center or other to determine portion of the drain aperture 117 before it drips or is released from the drain aperture 117. Thus, the weight of the moisture or liquid forces the "drip tip" downward so that the moisture or liquid falls off.

The shaped perimeter or side rail elements 130 and 135 each comprise an elongate portion of material extending between two opposing notched end portions 132 and 137, respectively. In various exemplary embodiments, the profile of the side rail elements 130 and 135 provides smooth, rounded horizontal outer edges.

In various exemplary embodiments, the side rail elements 130 and 135 are substantially rigid and are formed of wood or Medium Density Fiberboard (MDF). Alternate materials of construction may include one or more of the following: a polymeric material such as a polymeric composite, steel, aluminum, titanium, and/or other metals, as well as various alloys and composites thereof, glass-hardened polymers, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset materials, and/or various combinations of the foregoing. Thus, it should be understood that the material or materials used to form the side rail elements 130 and 135 is a design choice based on the desired appearance, strength, and/or functionality of the side rail elements 130 and 135.

As illustrated most clearly in FIGS. 12-15, the notched end portions 132 of the side rail elements 130 and the notched end portions 137 of the side rail elements 135 are shaped so as to allow the side rail elements 130 and 135 to interact with corner connector slots 162 of the corner connector elements 160. It should be appreciated that the notched end portions 132 and 137 can comprise various shapes and sizes, which correspond to at least a portion of the corner connector slots 162 of the corner connector elements 160.

Dowel holes 139 are formed at spaced apart locations proximate the notched end portions 132 and 137. The dowel holes 139 are formed so as to be aligned with and accept at least a portion of the ramped dowels 164 of the corner connector elements 160. It should be understood that the dowel holes 139 may comprise various shapes and sizes, which are capable of receiving at least a portion of a corresponding ramped dowels 164 of the corner connector element 160.

Each of the side rail elements 130 has at least one notch or side rail groove 133 formed on an interior side of the side rail element 130, perpendicular to the longitudinal axis of the side rail element 130. Likewise, each of the side rail elements 135 has at least one notch or side rail groove 138 formed on an interior side of the side rail element 135, perpendicular to the longitudinal axis of the side rail element 135. These one or more notches are formed so as to accept at least a portion of an end portion of a spine element 140 or a rib element 150. The notches 133 and 138 serve to align the interior support spine elements 140 and rib elements 150 during assembly of the support structure 100, without the need for external jigs or fixtures.

In various exemplary embodiments, wherein fasteners 170 are used to secure the side rail elements 130 and 135 to the spine elements 140 and/or rib elements 150, fastener apertures 131 are optionally formed through the side rail elements 130 and fastener apertures 136 are optionally formed through the side rail elements 135. The fastener apertures 131 and 136 may comprise a constant diameter hole bored through the side rail elements 130 and 135. Alternatively, the fastener apertures 131 and 136 may comprise tapered or countersunk portions. Typically, the fastener apertures 131 are formed at spaced apart locations centered along the side rail grooves 133 of the side rail elements 130. As illustrated, two fastener apertures 131 are formed at spaced apart locations along each of the side rail grooves 133.

Fastener apertures 136 are formed centered along the side rail grooves 138 of the side rail elements 135. As illustrated, a single fastener aperture 136 is formed through each side rail groove 138.

It should be appreciated that the number and placement of fastener apertures 131 and 136 is a design choice based upon the number of fasteners 170 to be used to secure the side rail elements 130 and 135 to the spine elements 140 and/or rib elements 150.

The side rail elements 130 are substantially similar to the side rail elements 135. Most notably, the length of the side rail elements 130 may be different from the length of the side rail elements 135. While the length of the side rail elements 130 is illustrated and described as being longer than the length of the side rail elements 135, it should be appreciated that this is merely illustrative and not a restriction as to the length of the side rail elements 130 or 135. Thus, in various exemplary embodiments the overall length of the side rail elements 130 may be greater than, less than, or equal to the overall length of the side rail elements 135. The overall length of the side rail elements 130 and/or 135 is a design choice based upon the desired overall size and shape of the support structure 100.

The spine elements 140 each comprise an elongate portion of material, having one or more half-lap joint notches 142 formed along an upper portion of the spine elements 140.

In various exemplary embodiments, wherein fasteners 170 are used to secure the side rail elements 130 and 135 to the spine elements 140, a spine aperture 144 is optionally formed into each end of the spine element 140. The spine apertures 144 may comprise a constant diameter hole bored into the ends of the spine elements 140. Alternatively, the spine apertures 144 may comprise compound apertures formed so as to accept the components of a barrel nut and bolt assembly. While a single spine aperture 144 is illustrated as being included in each end of the spine elements 140, it should be appreciated that two or more spine apertures 144 may be used.

Similarly, the rib elements 150 each comprise an elongate portion of material, having one or more half-lap joint notches 152 formed along a lower portion of the rib elements 150. The joint notches 152 are shaped so as to interact with the joint notches 142 of the spine elements 140, such that the spine elements 140 and the rib elements 150 can be secured together.

Thus, the rib elements 150 and spine elements 140 are able to be attached together in an interlocking fashion by means of the engineered half-lap joints notches 142 and 152 and form a supplemental load distribution structure of the support structure 100. The rib elements 150 and spine elements 140 also serve to square the entire assembly support structure 100 during and after assembly.

In various exemplary embodiments, wherein fasteners 170 are used to secure the side rail elements 130 and 135 to the rib elements 150, at least one rib aperture 154, and typically two or more rib apertures 154, is optionally formed into each end of the rib elements 150. The rib apertures 154 may comprise a constant diameter hole bored into the ends of the rib elements 150. Alternatively, the rib apertures 154 may comprise compound apertures formed so as to accept the components of a barrel nut and bolt assembly.

In various exemplary embodiments, as illustrated most clearly in FIGS. 11-21, the support structure 100 also includes optional corner connector elements 160. As illustrated most clearly in FIGS. 11-16, the corner connector elements 160 include corner connector slots 162 arranged approximately 90° relative to each other and formed so as to accept at least a portion of the notched end portions 132 and 137 of the side rail elements 130 and 135, respectively.

Aesthetically, the corner connector elements 160, if included, serve to round the vertical outer edges of the assembly support structure, while maintaining the radii of the assembly support structure's top and bottom edges. Structurally, the corner connector elements provide substantial impact resistance to corner loading and flexible resistance to parallelogram deformation.

Ramped dowels 164 extends at spaced apart locations from the corner connector elements 160 and are formed so as to interact with dowel holes 139 formed at corresponding, spaced apart locations proximate the notched end portions 132 and 137. The dowel holes 139 are formed so as to be aligned with and accept at least a portion of the ramped dowels 164 of the corner connector elements 160. When the notched end portions 132 and/or 137 are slid into the corner connector slots 162, the ramp surface of the ramped dowels 164 are contacted by the end portions 132 and/or 137 and are deformed so as to allow a portion of the end portions 132 and/or 137 to pass by until the ramped dowels 164 engage corresponding dowel holes 139 and return towards their normal position.

When appropriate ramped dowels 164 are secured within the dowel holes 139, the ramped dowels 164 lock into the dowel holes 139 to prohibit further movement of the side rail elements 130 and 135 relative to the corner connector elements 160.

A corner connector shelf 166 is included on the corner connector element 160. The corner connector shelf 166 extends substantially horizontally from an interior portion of the corner connector element 160. The corner connector shelf 166 includes a chamfered edge that is formed so as to engage the diagonal corner flaps 123 of the top deck panel 110 and act as an additional support for the corner flaps 123 and the top deck panel 110. In various exemplary embodiments, a lip portion of the corner connector shelf 166 further retains at least a portion of the corner flap 123.

In various exemplary embodiments, the elements of the support structure 100 are constructed in two, separate stages. In the initial assembly stage, as illustrated most clearly in FIGS. 5-10, the side rail elements 130 and 135 are affixed to the top surface 111 of the top deck panel 110 in the area of the side flaps 120. In various exemplary embodiments, the side rail elements 130 and 135 are affixed to the top surface 111, by adhesives. Alternatively, the side rail elements 130 and 135 may be affixed to the top surface 111 via heat welding, staples, screws, nails, or other fasteners or fastening means.

The side rail elements 130 are affixed so that the side rail grooves 133 are aligned with the panel notches 115. Likewise, the side rail elements 135 are affixed so that the side rail grooves 138 are aligned with the panel notches 115.

By providing the structure including the top deck panel 110 and the affixed side rail elements 130 and 135, a partially assembled support structure is provided that is relatively flat and easily transportable. The remaining elements used to form the support structure 100, including the spine elements 140, the rib elements 150, and the corner connector elements 160, can also be easily packaged and transported together with a partially assembled support structure.

Once provided with the elements to construct the support structure 100, the top deck panel (with the affixed side rail elements 130 and 135) is placed so that the bottom surface 112 faces upward in a top surface 111 of the side rail elements 130 and 135 face downward.

Figure 10:
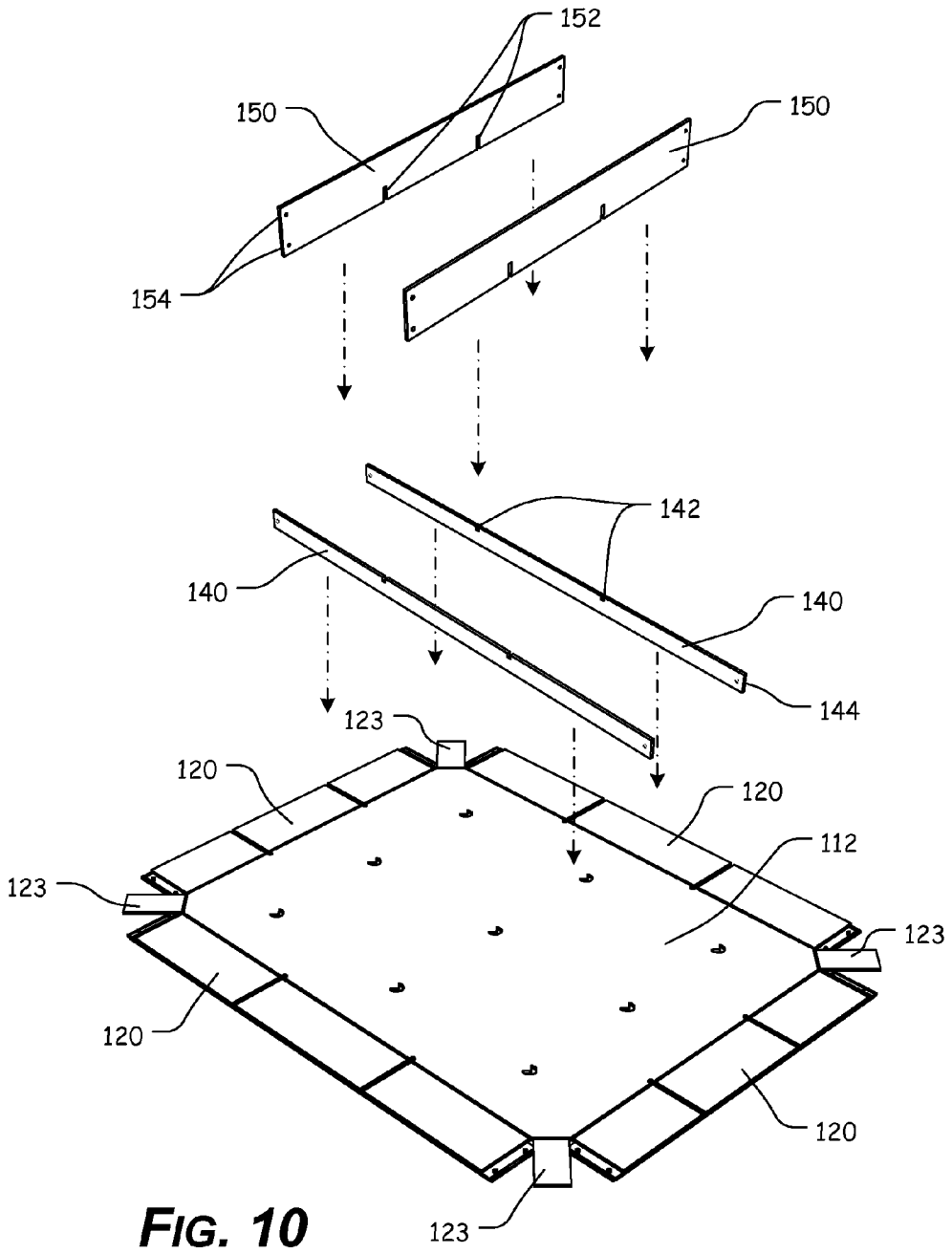
FIG. 10 illustrates an exploded, top, perspective view showing a first exemplary embodiment of various rib elements and spine elements together with a top deck panel having various side rail elements attached or coupled to the top deck panel, according to this invention.

Next, as illustrated in FIG. 10, a final assembly stage can be accomplished and the spine elements 140 are placed atop the bottom surface 112 at spaced apart locations, with the spine notches 142 facing upward. The rib elements 150 are positioned above the spine elements 140 with the rib and notches 152 facing downward. The spine elements 140 and rib elements 150 are then aligned such that corresponding rib notches 152 are aligned with spine notches 142. The rib elements 150 are then frictionally joined to the spine elements 140, via interaction of corresponding rib notches 152 and spine notches 142.

While the support structure 100 is shown and described as including to spine elements 140 and two rib elements 150, it should be appreciated that the number of spine elements 140 and rib elements 150 is a design choice based upon the desired functionality, rigidity, and/or strength of the support structure 100.

Once the rib elements 150 are joined to the spine elements 140, a self-supporting support structure is created. In various exemplary embodiments, the rib elements 150 remaining joined to the spine elements 140 by a frictional engagement. Alternatively, once joined, the rib elements 150 may be maintained in a joint relationship with the spine elements 145 use of adhesives, staples, screws, nails, or other fasteners or fastening means.

Figure 11:
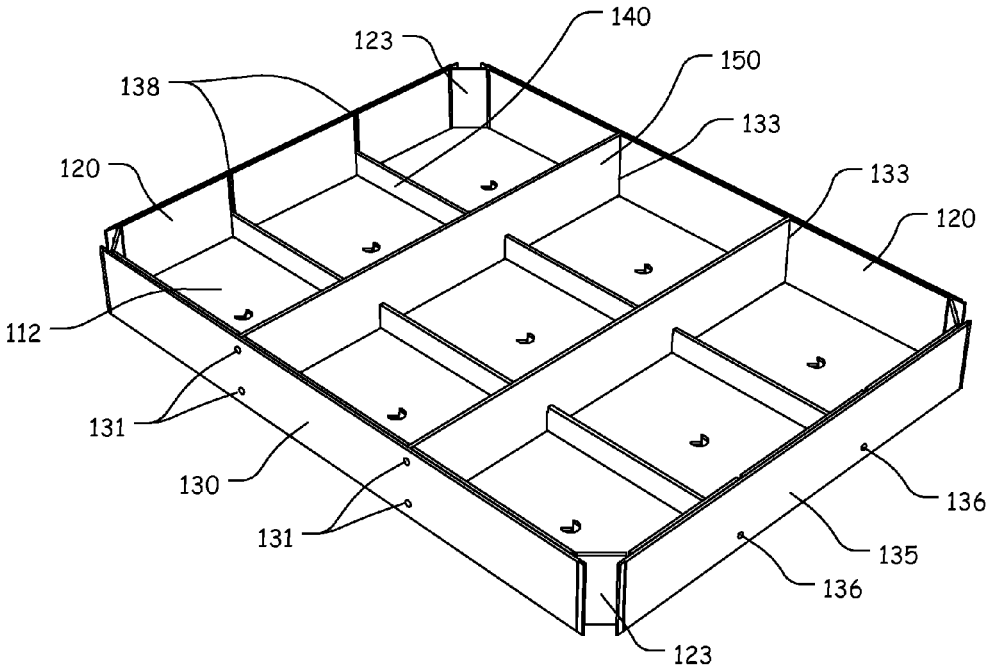
FIG. 11 illustrates a top, perspective view showing a partially assembled first exemplary embodiment of a support structure, according to this invention.
Figure 12:
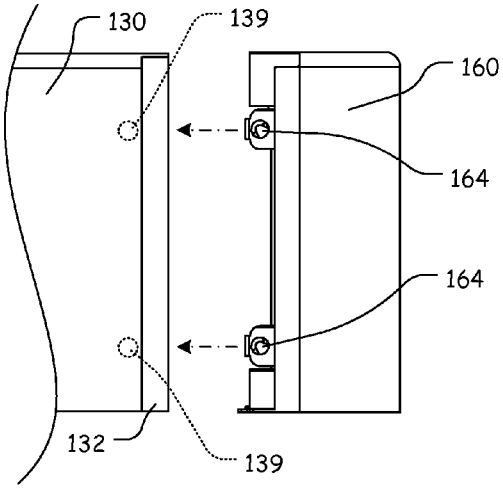
FIG. 12 illustrates a first side view showing an exemplary corner connector aligned with an exemplary side rail elements, according to this invention.
Figure 13:
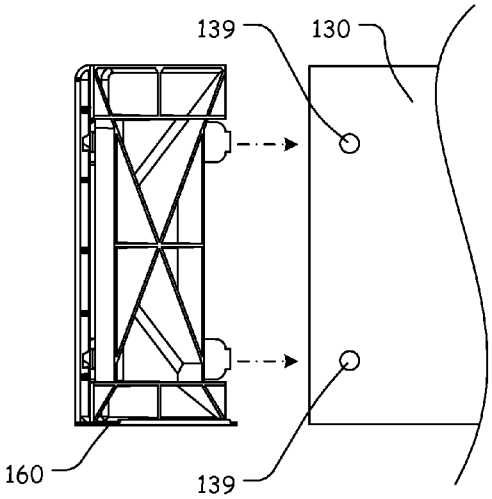
FIG. 13 illustrates a second side view showing an exemplary corner connector aligned with an exemplary side rail elements, according to this invention.
Figure 14:
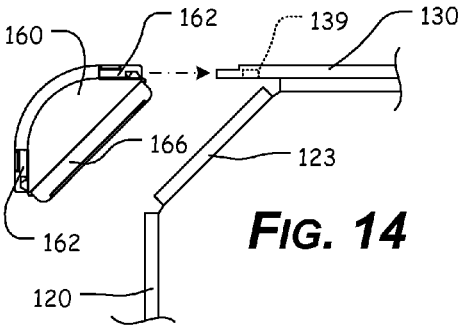
FIG. 14 illustrates a top view showing an exemplary corner connector aligned with an exemplary side rail elements, according to this invention.
Figure 15:
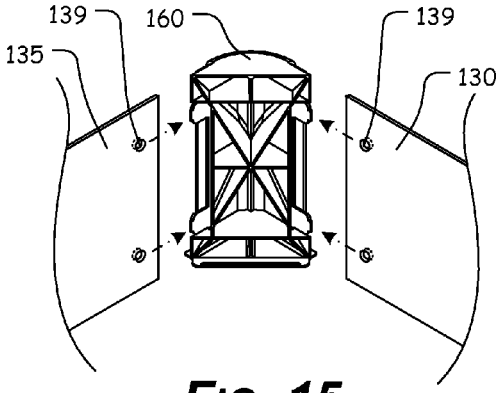
FIG. 15 illustrates a top perspective view showing an exemplary corner connector aligned with two exemplary side rail elements, according to this invention.

Once the self-supporting support structure has been created, the side flaps 120 are folded upward, as illustrated in FIG. 11, so that the ends of the spine elements 140 and the rib elements 150 are positioned within the side rail grooves 133 and 138, respectively. When properly positioned, the side rail elements 130 and 135 are each guided, by the interaction of the end portions of the spine elements 140 and the rib elements 150 and the side rail grooves 133 and 138, so that the end surface of the spine elements 140 and the rib elements 150 are contained within the side rail grooves 133 and 138, respectively.

In this position, the fastener apertures 136 are aligned with the spine apertures 144 and the faster apertures 131 are aligned with the rib apertures 154.

Figure 16:
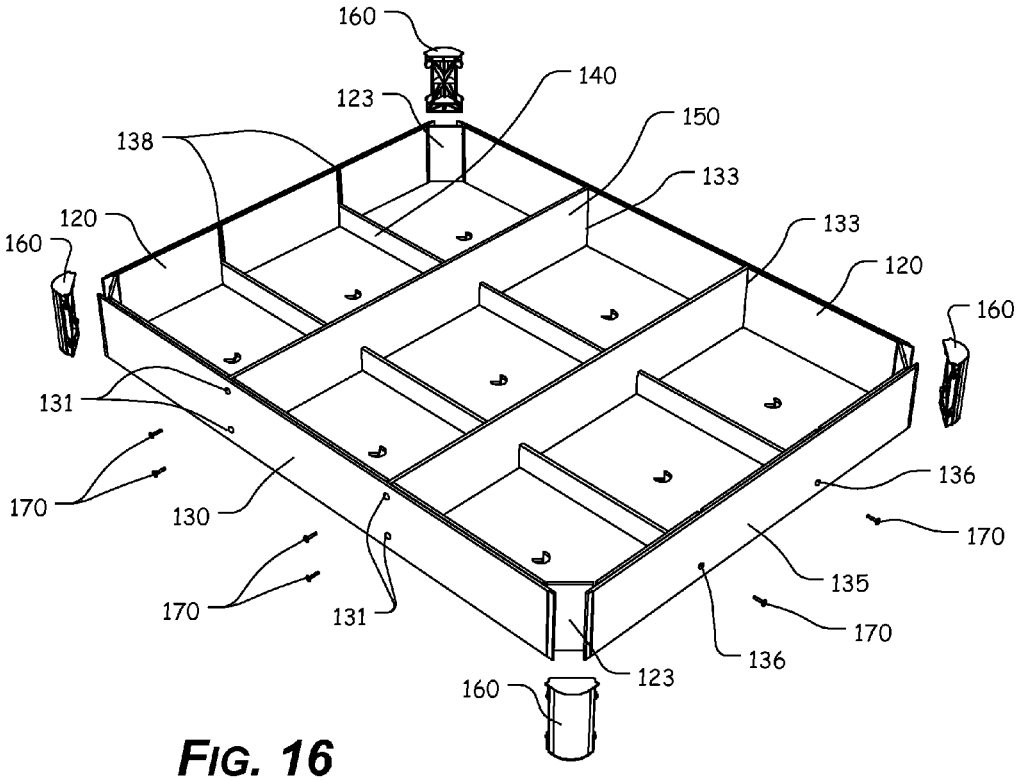
FIG. 16 illustrates a partially exploded, top, perspective view showing a partially assembled first exemplary embodiment of a support structure having aligned exemplary corner connector elements, according to this invention.
Figure 17:
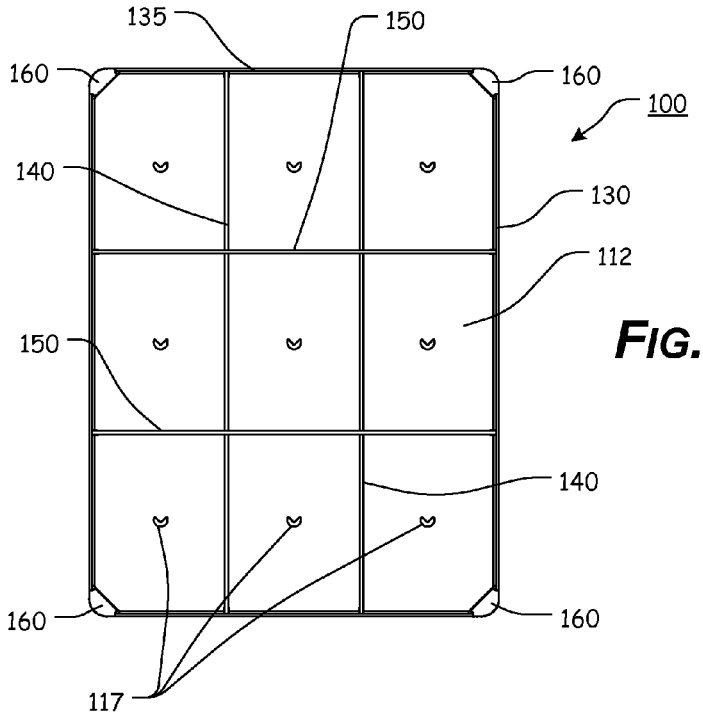
FIG. 17 illustrates a bottom view showing an assembled first exemplary embodiment of a support structure, according to this invention.
Figure 18:
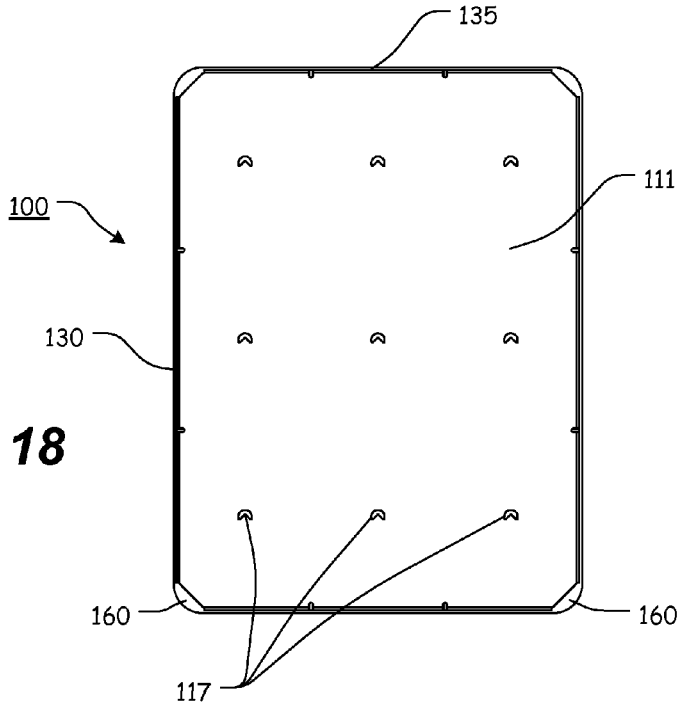
FIG. 18 illustrates a top view showing an assembled first exemplary embodiment of a support structure, according to this invention.
Figure 19:
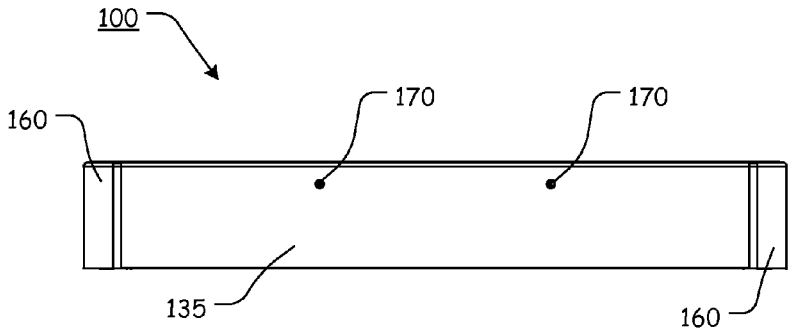
FIG. 19 illustrates a front side view showing an assembled first exemplary embodiment of a support structure, according to this invention (it being appreciated that the back side view is a mirror image of the front side view)
Figure 20:
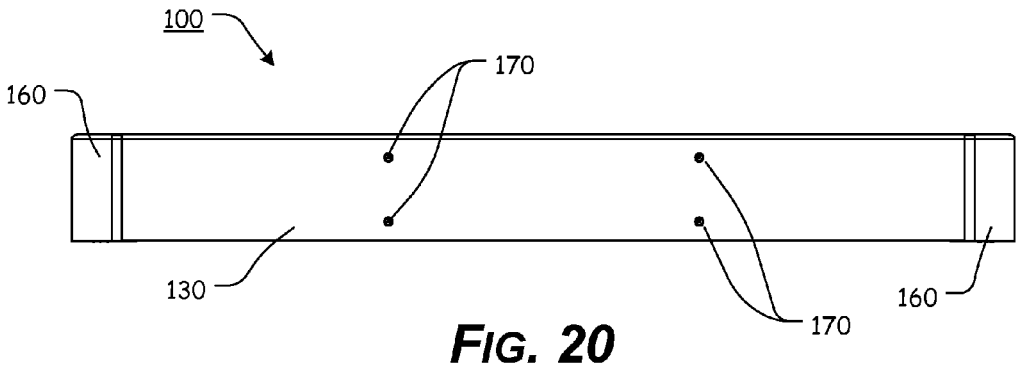
FIG. 20 illustrates a right side view showing an assembled first exemplary embodiment of a support structure, according to this invention (it being appreciated that the left side view is a mirror image of the right side view)
Figure 21:
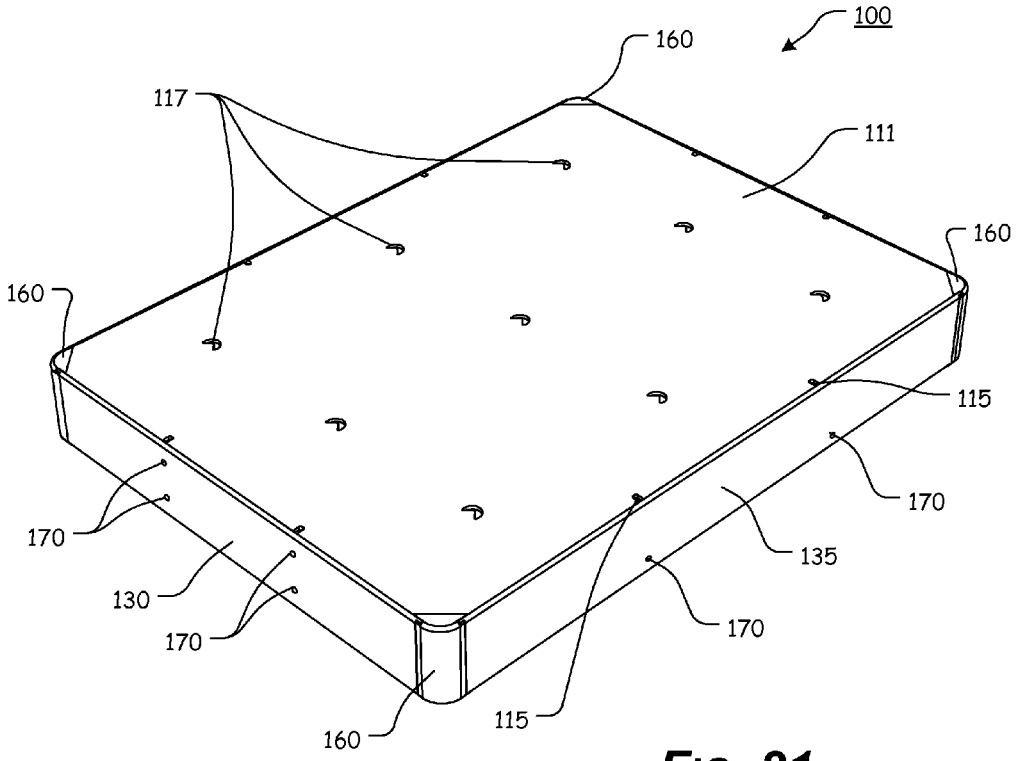
FIG. 21 illustrates a top, perspective view showing a fully assembled first exemplary embodiment of a support structure, according to this invention.

As illustrated in FIG. 16, the corner flaps 123 are folded upward and the corner connector elements 160 are then positioned at locations proximate the relative corners of the assembled structure. The corner connector elements 160 are attached to adjacent ends of the side rail elements 130 and 135, as discussed above, with reference to FIGS. 12-15. The fasteners 170 are inserted within the faster apertures 131 and 136 and secured such that the side rails 130 are secured to the rib elements 150 and the side rail elements 135 are secured to the spine elements 140.

Once the support structure 100 is fully assembled, as illustrated in FIGS. 17-22, it can be flipped back to its upright position and is ready for use. It should be appreciated that while the support structure 100 has been described as potentially being used as a mattress foundation support, the support structure 100 can be used as any support structure, stage, platform, or the like. It should also be understood and appreciated that the support structure 100 can be used as a single support structure or can be abutted against, placed adjacent to, or removably or permanently joined to other support structures 100 to form a compound or amalgamated support structure.

It should also be appreciated that a more detailed explanation of the specific tools and/or fastening means used to assemble the support structure 100, further instructions regarding how to assemble and use the support structure 100, and certain other items and/or techniques necessary for the implementation and/or operation of the various exemplary embodiments of the present invention are not provided herein because such elements are commercially available and/or such background information will be known to one of ordinary skill in the art. Therefore, it is believed that the level of description provided herein is sufficient to enable one of ordinary skill in the art to understand and practice the systems and methods as described.

Figure 22:
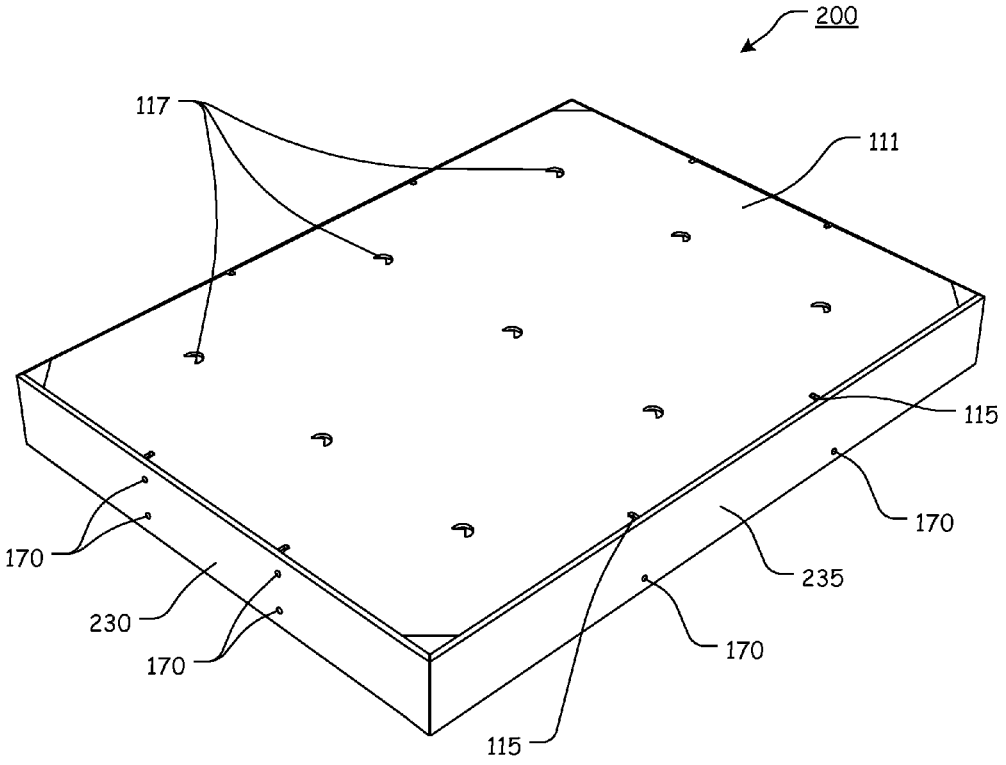
FIG. 22 illustrates a top, perspective view showing a fully assembled second exemplary embodiment of a support structure, according to this invention.

FIG. 22 illustrates a second exemplary embodiment of a support structure according to this invention. As illustrated in FIG. 22, the support structure 200 comprises at least some of a top deck panel 110 having a top surface 111, a bottom surface 112, panel notches 115, drain apertures 117, side flaps 120, corner flaps 123, shaped perimeter or side rail elements 230 having fastening apertures 231, side rail grooves 233, side rail elements 235 having fastening apertures 236, the side rail grooves 238, spine elements 140 having spine notches 142 and spine apertures 144, and rib elements 150 having rib notches 152 and rib apertures 154, and fasteners 170.

It should be understood that each of these elements corresponds to and operates similarly to the support structure 100, the top deck panel 110, the top surface 111, the bottom surface 112, the panel notches 115, the drain apertures 117, the side flaps 120, the corner flaps 123, the shaped perimeter or side rail elements 130, the fastening apertures 131, the side rail grooves 133, the side rail elements 135, the fastening apertures 136, the side rail grooves 138, the spine elements 140, the spine notches 142, the spine apertures 144, the rib elements 150, the rib notches 152, the rib apertures 154, and the fasteners 170 of FIGS. 1-21.

However, as shown in FIG. 22, the optional corner connector elements 160 are not utilized and the side rail elements 230 and 235 extend so as to abut to one another informed corners of the support structure 200.

While this invention has been described in conjunction with the exemplary embodiments outlined above, the foregoing description of exemplary embodiments of the invention, as set forth above, are intended to be illustrative, not limiting and the fundamental invention should not be considered to be necessarily so constrained. It is evident that the invention is not limited to the particular variation set forth and many alternatives, adaptations modifications, and/or variations will be apparent to those skilled in the art.

It is to be understood that the phraseology of terminology employed herein is for the purpose of description and not of limitation. Unless defined otherwise, all technical and scientific terms used herein have the same meaning as commonly understood by one of ordinary skill in the art to which this invention belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the invention, such that others may, by applying current knowledge, change, vary, modify, and/or adapt these exemplary, non-limiting embodiments for various applications without departing from the spirit and scope of the invention and elements or methods similar or equivalent to those described herein can be used in practicing the present invention. Any and all such changes, variations, modifications, and/or adaptations should and are intended to be comprehended within the meaning and range of equivalents of the disclosed exemplary embodiments and may be substituted without departing from the true spirit and scope of the invention.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A rapid assembly support structure, comprising:

a top deck panel comprising a portion of material having a top surface and a bottom surface, extending to side flaps, wherein the side flaps extend outwardly, along at least a portion of each side of the top deck panel, wherein the side flaps include one or more panel notches formed through at least a portion of the side flaps, wherein the top deck panel further comprises corner flaps, wherein the corner flaps extend outwardly from at least a portion of each corner of the top deck panel;

a plurality of side rail elements, wherein each side rail element comprises an elongate portion of material extending between two opposing notched end portions, wherein each side rail element has at least one side rail groove formed on an interior side of the side rail element, perpendicular to a longitudinal axis of the side rail element, wherein the side rail elements are affixed to the top surface of the top deck panel, atop the side flaps;

one or more spine elements, wherein each spine element comprises an elongate portion of material having one or more spine element notches formed along an upper portion thereof;

one or more rib elements, wherein each rib element comprises an elongate portion of material having one or more rib element notches formed along a lower portion thereof, wherein the rib element notches are shaped so as to interact with the spine element notches; and corner connector elements, wherein each corner connector element includes corner connector slots arranged approximately 90° relative to each other, and wherein each corner connector slot is formed so as to accept at least a portion of the notched end portion of the side rail element.

2. The rapid assembly support structure of claim 1, wherein the top deck panel is substantially triangular, square, rectangular, or pentangular.

3. The rapid assembly support structure of claim 1, wherein at least a portion of the top deck panel is formed of a fabric, paper, cardboard, plastic, woven fabrics, canvas, acrylics, sheet fabrics, films, nylon, spandex, vinyl, Polyvinyl Chloride (PVC), or neoprene.

4. The rapid assembly support structure of claim 1, wherein the corner flaps are separate from the side flaps.

5. The rapid assembly support structure of claim 1, wherein a plurality of substantially "C", "U", or "V" shaped drain apertures are formed through the top deck panel at spaced apart locations.

6. The rapid assembly support structure of claim 1, wherein the notched end portions of the side rail elements are shaped so as to allow the side rail elements to interact with the corner connector slots of the corner connector elements.

7. The rapid assembly support structure of claim 1, wherein ramped dowels extends at spaced apart locations from the corner connector elements and are formed so as to interact with dowel holes formed at corresponding, spaced apart locations proximate the notched end portions.

8. The rapid assembly support structure of claim 7, wherein dowel holes are formed at spaced apart locations proximate the notched end portions, so as to be aligned with and accept at least a portion of the ramped dowels of the corner connector elements.

9. The rapid assembly support structure of claim 1, wherein each of the side rail grooves is formed so as to accept at least a portion of an end portion of a spine element or a rib element.

10. The rapid assembly support structure of claim 1, wherein fastener apertures are formed through the side rail elements.

11. The rapid assembly support structure of claim 10, wherein the fastener apertures are formed at spaced apart locations centered along the side rail grooves of the side rail elements.

12. The rapid assembly support structure of claim 1, wherein the interior side of the side rail elements are affixed to the top surface of the top deck panel, atop the side flaps.

13. The rapid assembly support structure of claim 1, wherein each corner connector element further comprises a corner connector shelf that extends substantially horizontally from an interior portion of the corner connector element and wherein the corner connector shelf includes a chamfered edge that is formed so as to engage a portion of the corner flap of the top deck panel.

14. The rapid assembly support structure of claim 1, wherein the side rail elements are affixed so that the side rail grooves are aligned with the panel notches.

15. The rapid assembly support structure of claim 1, wherein the side rail elements and are affixed to the top surface, via adhesives, heat welding, staples, screws, nails, or other fasteners or fastening means.

16. A rapid assembly support structure, comprising:

a top deck panel comprising a portion of material having a top surface and a bottom surface, extending to side flaps, wherein the side flaps extend outwardly, along at least a portion of each side of the top deck panel, wherein the side flaps include one or more panel notches formed through at least a portion of the side flaps, wherein the top deck panel further comprises corner flaps, wherein the corner flaps extend outwardly from at least a portion of each corner of the top deck panel, wherein the corner flaps are separate from the side flaps, and a plurality of drain apertures formed through the top deck panel at spaced apart locations; and a plurality of side rail elements, wherein each side rail element comprises an elongate portion of material extending between two opposing notched end portions, wherein each side rail element has at least one side rail groove formed on an interior side of the side rail element, perpendicular to a longitudinal axis of the side rail element, wherein the side rail elements are affixed to the top surface of the top deck panel, atop the side flaps.

17. The rapid assembly support structure of claim 16, wherein each drain aperture comprises a substantially "C", "U", or "V" shaped drain aperture.

18. A method for assembling a rapid assembly support structure, the rapid assembly support structure, comprising:

the rapid assembly support structure comprising:

a top deck panel comprising a portion of material having a top surface and a bottom surface, extending to side flaps, wherein the side flaps extend outwardly, along at least a portion of each side of the top deck panel, wherein the top deck panel further comprises corner flaps, wherein the corner flaps extend outwardly from at least a portion of each corner of the top deck panel, wherein the corner flaps are separate from the side flaps, and a plurality of drain apertures formed through the top deck panel at spaced apart locations;

a plurality of side rail elements, wherein each side rail element comprises an elongate portion of material extending between two opposing notched end portions, wherein each side rail element has at least one side rail groove formed on an interior side of the side rail element, perpendicular to a longitudinal axis of the side rail element, wherein the side rail elements are affixed to the top surface of the top deck panel, atop the side flaps;

one or more spine elements, wherein each spine element comprises an elongate portion of material having one or more spine element notches formed along an upper portion thereof;

one or more rib elements, wherein each rib element comprises an elongate portion of material having one or more rib element notches formed along a lower portion thereof, wherein the rib element notches are shaped so as to interact with the spine element notches; and corner connector elements, wherein each corner connector element includes corner connector slots arranged approximately 90° relative to each other, and wherein each corner connector slot is formed so as to accept at least a portion of the notched end portion of the side rail element the method comprising:

placing the top deck panel such that the bottom surface faces upward;

placing the spine elements atop the bottom surface of the top deck panel at spaced apart locations, with the spine notches facing upward;

placing the rib elements above the spine elements with the rib and notches facing downward;

aligning the spine elements and the rib elements such that the rib notches are aligned with corresponding spine notches;

joining the rib elements to the spine elements, via interaction of corresponding rib notches and spine notches;

folding the side flaps upward so that end portions of the spine elements and end portions of the rib elements are positioned within the side rail grooves;

guiding the side rail elements, via the interaction of the end portions of the spine elements and the end portions of the rib elements and the side rail grooves, such that an end surface of the spine elements and an end surface of the rib elements are each contained within a side rail groove;

aligning the fastener apertures with spine apertures;

folding the corner flaps upward;

attaching the corner connector elements at locations proximate relative corners of the assembled structure; and securing the side rails to the rib elements and the spine elements.

* * * * *